US006362137B1

(12) United States Patent
Bhatnagar et al.

(10) Patent No.: US 6,362,137 B1
(45) Date of Patent: Mar. 26, 2002

(54) PROCESS FOR PREPARING A CORROSION INHIBITOR/METAL PASSIVATOR ADDITIVE FOR LUBRICANT, GREASE AND FUEL APPLICATIONS FROM WASTE REFINERY STREAMS

(75) Inventors: Akhilesh Bhatnagar; Deepak Kumar Tuli; Rakesh Sarin; Ajay Arora; Pankaj Kumar Mandal, all of Mumbai (IN)

(73) Assignee: Indian Oil Corporation, Maharastra (IN)

( * ) Notice: Subject to any disclaimer, the term of this patent is extended or adjusted under 35 U.S.C. 154(b) by 0 days.

(21) Appl. No.: 09/641,119

(22) Filed: Aug. 17, 2000

(30) Foreign Application Priority Data

Feb. 29, 2000 (IN) ..... 171/BOM/2000

(51) Int. Cl.[7] ..... C10M 135/36

(52) U.S. Cl. ..... 508/273; 252/391; 252/394; 548/142

(58) Field of Search ..... 508/273

(56) References Cited

U.S. PATENT DOCUMENTS

| | | | | | |
|---|---|---|---|---|---|
| 3,087,932 | A | | 4/1963 | Little | 260/302 |
| 3,966,623 | A | * | 6/1976 | Krug et al. | 508/273 |
| 4,097,387 | A | | 6/1978 | Caspari | 252/47.5 |
| 4,210,544 | A | * | 7/1980 | Burton et al. | 508/273 |
| 4,351,945 | A | * | 9/1982 | Brois et al. | 548/130 |
| 4,487,706 | A | | 12/1984 | Lam | 252/47.5 |
| 4,533,480 | A | * | 8/1985 | Holstedt et al. | 508/273 |
| 4,871,465 | A | * | 10/1989 | Hutchinson | 508/273 |
| 5,094,763 | A | * | 3/1992 | Tochigi et al. | 508/273 |
| 5,622,922 | A | * | 4/1997 | Clarke et al. | 508/272 |
| 5,874,390 | A | * | 2/1999 | Gong et al. | 508/273 |

* cited by examiner

*Primary Examiner*—Ellen M. McAvoy
(74) *Attorney, Agent, or Firm*—Needle & Rosenberg, PC

(57) ABSTRACT

This invention relates to a cost effective process for preparing a corrosion inhibitor/metal passivator additive for lubricant, grease and fuel applications from waste refinery streams, comprising reacting 2,5-dimercapto-1,3,4-thiadiazole either in powder form or in solution form in polar organic solvent, with disulphide oil obtained from Merox extraction/caustic wash of the refinery streams, in the presence or absence of redox agent.

33 Claims, No Drawings

PROCESS FOR PREPARING A CORROSION INHIBITOR/METAL PASSIVATOR ADDITIVE FOR LUBRICANT, GREASE AND FUEL APPLICATIONS FROM WASTE REFINERY STREAMS

FIELD OF THE INVENTION

This invention relates to a process for preparing a corrosion inhibitor/metal passivator additive for lubricant, grease and fuel applications from waste refinery streams.

BACKGROUND

It is well known that various derivatives of 2,5-dimercapto-1,3,4-thiadiazole are useful lubricant, grease and fuel additives for inhibition of copper activity, i.e., corrosion or staining. Many patents have been issued on various derivatives of 2,5-dimercapto-1,3,4-thiadiazole. Amongst various derivatives of 2,5-dimercapto-1,3,4-thiadiazole, the bisulfides are preferred as corrosion inhibitors/metal passivator additives for lubricants, greases and fuels. These disulfides react with large quantities of sulfur or active sulfur compounds to give compounds, which are non-corrosive to metals, especially copper and silver. Their capacity to react with sulfur is large, as 2,5-dimercaptothiadiazole-bis(n-dodecyl) disulfide is able to react with 16 gram atoms of sulphur and the resulting product is a non-corrosive in modified EMD silver strip test. Thus 2,5-dimarcapto thiadiazole disulfides have ability to act as "sulfur sink".

DESCRIPTION OF RELATED ART

U.S. Pat. No. 3,087,932 discloses a method of making 2,5-bis(alkyldisulphide)-1,3,4-thiadiazole. This process involves the reaction of hydrogen peroxide with 2,5-dimercapto-1,3,4-thiadiazole or its alkyl metal salt and alkyl mercaptan.

U.S. Pat. No. 4,097,387 describes metal deactivators derived from 2,5-dimercapto-1,3,4-thiadiazole by reaction with sulfur halide and an olefin to form an intermediate, which is then treated with sodium or potassium salt of thiadiazole. More recently, U.S. Pat. No. 4,487,706 describes the preparation of metal deactivator by reacting olefin, sulfur dichloride and 2,5-dimercapto-1,3,4-thiadiazole in a single step.

Other method of making these disulphides of thiadiazole involves reaction of chloromercaptan with 2,5-dimercapto-1,3,4-thiadiazole or formation of 2,5-dimercapto thiadiazole dichloride and subsequent reaction with mercaptans. This latter reaction is specially preferred in view of the high temperature stability of the dichlorides than alkyl sulfenyl chlorides. These methods have been reviewed by Ellis K Fields in Industrial and Engineering Chemistry, Vol. 49, 1957, p. 1361 to 1364; which is incorporated herein as reference.

As can be seen from the above description of the prior-art, the metal deactivator/corrosive inhibiting additives from 2,5-dimercapto-1,3,4-thiadiazole have been prepared either by reaction of thiadiazole with alkyl mercaptans or by using olefins and sulfur dichloride.

The disadvantages of the above processes are:

Alkyl mercaptans are expensive material and the cost of corrosion inhibitor/metal deactivator additives produced by these procedures becomes very high.

In U.S. Pat. No. 4,487,706, during the reaction of thiadiazole with sulfur dichloride and olefin, hydrogen chloride vapours are evolved and the additives contain residual chlorine by introduction of the HCl gas into olefinic unsaturation. This process evolves corrosive HCl gas and the product contains higher amount of chlorine and hence is not advantageous.

SUMMARY OF THE INVENTION

The object of the present invention is to overcome the aforesaid disadvantages by providing one step reaction process at much reduced cost.

To achieve the said objective, this invention provides a process for preparing a corrosion inhibitor/metal passivator additive for lubricant, grease and fuel applications from waste refinery streams, comprising reacting 2,5-dimercapto-1,3,4-thiadiazole either in powder form or in solution form in polar organic solvent, with disulphide oil obtained from Merox extraction/caustic wash of the refinery streams.

The said reaction takes places in the presence of redox agent for better yield.

The said corrosion inhibitor/metal passivator additive is 2,5-bis(alkylmercapto)-1,3,4-thiadiazole.

The disulphide oil used is obtained from Merox extraction/caustic wash of the cracked LPG or the visbreaker naphtha of boiling range 30–150° C. or the mixture of sulfur containing refinery streams.

The composition of said disulphide oil consists of any number of components ranging from $C_4H_{10}S_2$ to $C_{12}H_{26}S_2$.

The composition of said disulphide oil is:

| S. No. | Component | Mol. Formula |
|---|---|---|
| 1. | Ethylisopropyl disulphide | $C_5H_{12}S_2$ |
| 2. | Diisopropyl disulphide | $C_6H_{14}S_2$ |
| 3. | Isopropyl n-propyl disulphide | $C_6H_{14}S_2$ |
| 4. | Ethylisobutyl disulphide | $C_6H_{14}S_2$ |
| 5. | Di-n-propyl disulphide | $C_6H_{14}S_2$ |
| 6. | n-Butyl n-propyl disulphide | $C_7H_{16}S_2$ |
| 7. | 2-Methylpropyl n-propyl disulphide | $C_7H_{16}S_2$ |
| 8. | 2-Methylpropyl iso-propyl disulphide | $C_7H_{16}S_2$ |
| 9. | n-butyl isopropyl disulphide | $C_7H_{16}S_2$ |
| 10. | Di n-butyl disulphide | $C_8H_{18}S_2$ |
| 11. | $C_5/C_3$ disulphide | $C_8H_{18}S_2$ |
| 12. | 1-cyclohexyl n-propyl disulphide | $C_9H_{20}S_2$ |
| 13. | $C_4/C_5$ disulphide | $C_9H_{20}S_2$ |
| 14. | $C_4/C_6$ disulphide | $C_{10}H_{22}S_2$ |
| 15. | $C_5/C_5$ disulphide | $C_{10}H_{22}S_2$ |
| 16. | $C_5/C_6$ disulphide | $C_{11}H_{24}S_2$ |

The redox agent used is hydrogen peroxide.

The instant process comprises dissolving 2,5,dimercapto-1,3,4-thiadiazole in a polar organic solvent, adding dropwise hydrogen peroxide and the temperature of the mixture is maintained at 15–20° C. till a pale yellow precipitate is separated, the resulting slurry is stirred and disulphide oil, obtained from Merox extraction/caustic wash of the refinery streams, is added at room temperature and the reaction mixture is heated to 70–80° C. till reaction is complete, cooling the contents to room temperature and removing the organic solvent under reduced pressure, adding non-polar organic solvent in the residue, separating the said non-polar solvent soluble portion, and distilling off the said non-polar solvent under reduced pressure to obtain light yellow coloured liquid of 2,5-bis(alkyldisulphide)-1,3,4-thiadiazole.

The instant process comprises reacting 2,5-dimercapto-1,3,4-thiadiazole in powder form with disulphide oil obtained from Merox extraction/caustic wash of the refinery streams, heating the reaction mixture to 120–140° C., cooling the said reaction mixture to room temperature, extracting the reaction mixture with non-polar organic solvent and removing the said non-polar organic solvent under reduced pressure to get pale yellow product of 2,5-bis(alkyldisulphide)-1,3,4-thiadiazole.

The said polar solvent is alkyl alcohol and the alkyl alcohol is methyl alcohol, ethyl alcohol, isopropyl alcohol or mixtures thereof. However the preferred alcohol is ethyl alcohol.

The non-polar solvent used is hexane, petroleum ether, benzene, toluene or mixtures thereof.

The ratio of the reactants 2,5,dimercapto-1,3,4-thiadiazole and disulphide oil is in the ratio 1-4:4-1. The preferred ratio of the reactants 2,5,dimercapto-1,3,4-thiadiazole and disulphide oil is in the ratio 1:1.

0.5–1.2 mole of 30% hydrogen peroxide is added dropwise and 1–3 moles of disulphide oil is added to the reaction mixture and stirred at room temperature for about 2 hours.

To complete the reaction, the reaction mixture is refluxed for 6 to 10 hours.

For separating the said non-polar organic solvent soluble portion, 800–1100 ml. of non-polar organic solvent is added. The non-polar solvent is preferably hexane.

The lubricating oil composition comprises 0.01 to 6% of 2,5-bis(alkylmercapto)-1,3,4-thiadiazole, as the corrosion inhibitor/metal passivator additive.

DETAILED DESCRIPTION OF THE INVENTION

One of the raw material i.e. 2,5-dimercapto-1,3,4-thiadiazole may be prepared by reacting one mole of hydrazine or hydrazine salt with two moles of carbon disulphide as described in British Patent No. 747,048.

Further modification for the synthesis of 2,5-dimercapto-1,3,4-thiadiazole have been carried out and described in U.S. Pat. No. 4,599,425.

The disulphided oil of the present invention is produced during the refining operation for production of low sulfur LPG, sulphur free low boiling naphtha and other hydrocarbons to be used as fuels. Various low boiling fractions undergo Merox extraction process, in the presence of an alkali and a catalyst, leading to the formation of disulphides. Alternatively, these low boiling hydrocarbon fractions are freed from sulphur, mostly present in form of mercaptans, by washing with approx. 10% caustic solution. The extracted sodium mercaptides are water soluble and undergo facile aerial oxidation during storage in tanks to give the corresponding disulphides. These disulphides being insoluble in aqueous caustic separate out as a layer on the top. These disulphided layers pose disposal problem for refiners, as due to higher sulfur content it can neither be back blended nor can be sent to the furnace. This fraction (called disulfided oil) was analyzed by NMR ($^1H$ & $^{13}C$), GC. and GC-MS. Their analysis indicated the presence of dialkyldisulphides (linear, iso, tert and cyclic) predominantly having alkyl group on the carbon range of $C_3$ to $C_6$ and minor amounts (<5%) of mercaptans in $C_3$ to $C_6$ range. The composition of this disulphided oil as obtained by GC-MS is listed in table-1. The average composition of these disulphides can be taken as $C_8H_{18}S_2$.

The reaction of the disulphided oil, as obtained from the caustic wash of lower refinery streams, with 2,5-dimercapto-1,3,4-thiadiazole was carried out in two different conditions.

By adopting the first set of conditions, 0.5 mole of 2,5-dimercapto-1,3,4-thiadiazole was suspended in 100 ml of ethyl alcohol and 0.5 to 1.2 mole of 30% $H_2O_2$ was added dropwise to this solution. A solid started separating out in this exothermic addition, the temperature of which was maintained at 15–20° C. by use of the ice-bath. The disulphided oil, 1.0 to 3.0 moles, preferably 1.6 to 2.5 moles, is than added in one lot. The reaction mixture was stirred at room temperature for two hours and then refluxed for 6–10 hrs. After completion of the reaction, the solvent media alcohol is distilled off under reduced pressure and the residue taken up in 500 ml to 800 ml n-hexane. The hexane solvent fraction was separated and hexane removed to obtain the desired Corrosion inhibitor/metal deactivator in good yields.

By adopting the second set of conditions, the same additive composition could be obtained. These conditions involved direct fusion of thiadiazole with disulphided oil, without any redox reagent and the polar organic powder form. This direct fusion though is simpler process, but the yields of the product obtained were much lower.

The mechanism of reaction of 2,5-dimercapto-1,3,4-thiadiazole with disulphided oil in the presence of redox reagent, viz. $H_2O_2$ is believed to be free radical assisted. In the first step, $H_2O_2$ acts as an oxidation agent and oxidises the thiadiazole to bis-thiadiazole. This is evidenced by analysis of solid material obtained during the addition of $H_2O_2$ to 2,5-dimercapto 1,3,4-thiadiazole solution in ethyl alcohol. In the second step, $H_2O_2$ acting as a reducing agent, splits disulphided oil and bis-thiadiazole into corresponding mono sulphides. These mono sulphides then combine to give the 2,5-bis(alkylmercapto)-1,3,4-thiadiazole as the final product. This product was characterized by $^{13}$CNMR and FD-MS.

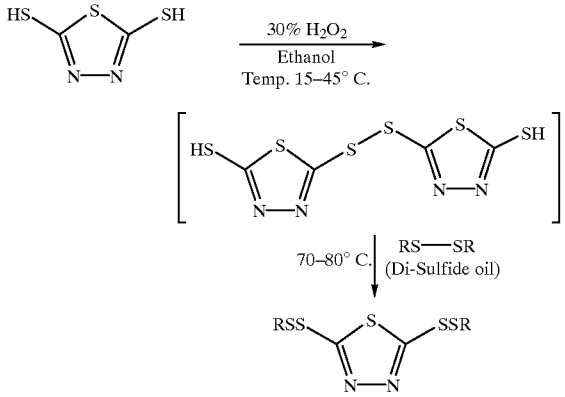

The authenticity of this mechanism was cross-checked by carrying out the reaction in the presence of an antioxidant of the type of free radical destroyer. The reaction does not proceed if an effective amount of 2,6-di-tert-butyl-4-methylphenol is present. This gives support to the free radical catalysed mechanism of this reaction.

The present invention will now be described with reference to the foregoing examples:

EXAMPLE 1

This example demonstrates the laboratory preparation of 2,5-bis(alkyldisulphide)-1,3,4-thiadiazole in high yield using hydrogen peroxide as the redox reagent and ethyl alcohol as the reaction medium.

A 1000 ml, three necked round bottomed flask was equipped with condenser, addition funnel, magnetic stirrer and thermocouple. The flask was charged with 2,5-dimercapto-1,3,4-thiadiazole (80 g, 0.53 moles) and ethyl alcohol (450 ml) and the stirring was initiated. $H_2O_2$ (30% solution, 60 ml) was introduced dropwise and the temperature of the mixture was maintained at 15–20° C. by use of the ice-bath. The addition of $H_2O_2$ was completed in 1 to 1.5 hrs when a pale yellow precipitate separated out and the resulting slurry was stirred for additional one hour, while the ice-bath was removed. The disulphided oil (266 gm, approx. 1.50 mole, calculated on mol. wt. of 178 i.e. $C_8H_{28}S_2$) was added in one lot to the reaction mixture kept at room temperature. Subsequently, the reaction mixture was heated to 70–80° C., under reflux and stirred at this temperature for 6–10 hrs. After completion of the reaction, the contents of the flask were cooled to room temperature and ethanol removed under reduced pressure. The residue thus obtained was taken up in 800–1100 ml of n-hexane and the hexane soluble portion separated. The hexane was distilled off under reduced pressure to obtain light yellow colored liquid (310 g, 89.6%)

EXAMPLE 2

A 500 ml, two necked, round bottomed flask was equipped with condenser, magnetic stirrer and a thermocouple. The flask was charged with 2,5-dimercapto-1,3,4-thiadiazole (40 g, 0.266 mole) and disulphide oil (88 g, 0.49 mole). The reaction mixture was heated to 120–140° C. with stirring for 8–10 hrs and then cooled to room temperature. The reaction mixture was extracted with hexane (300 ml×2) and the hexane removed under reduced pressure to get pale yellow product (42.2 g, 33%). This product was chemically equivalent to the product of example-1.

The product obtained from the above example was evaluated for copper corrosion efficacy by ASTM D-130 test. Commercial thiadiazole type of corrosion inhibitors/metal passivators, viz. Cuvan-484, Cuvan-826 (sold by M/s Vanderbilt, USA) and Amoco-150 (sold by Amoco) were also evaluated.

EXAMPLE 3

This example demonstrates the laboratory preparation of 2,5-bis(alkyldithio)-1,3,4, thiadiazole in high yield using hydrogen peroxide as the redox reagent and ethyl alcohol as the reaction medium.

A 100-ml, three-necked round-bottomed flask was equipped with condenser, addition funnel, magnetic stirrer and thermocouple. The flask was charged with 2,5 dimercapto-1,3,4-thiadiazole (40 gm. 0.266 moles), ethyl alcohol (350 ml) and the stirring was initiated $H_2O_2$ (30% solution, 35 ml) was introduced drop wise and the temperature of the mixture was maintained at 15–20° C. by use of the ice-bath. The addition of $H_2O_2$ was completed in 1 to 1.5 hrs., when a pale yellow precipitate separated out and the resulting slurry was stirred for additional one hour, while the ice-bath was removed. The disulphided oil was (95 gm. approx. 0.533 moles) added in one lot to the reaction mixture kept at room temperature. Subsequently, the reaction mixture was heated to 70–80° C., under reflux and stirred at this temperature for 6–10 hrs. After completion of the reaction, the content of the flask were cooled to room temperature and ethanol removed under reduced pressure. The residue thus obtained was taken up in 750–950 ml of n-hexane and the none soluble portion separated. The hexane was distilled off under reduced pressure to obtain light yellow colored liquid (119.88 gm. 88.8%).

EXAMPLE 4

A 500-ml, two necked, round-bottomed flasks were equipped with condenser, magnetic stirrer and thermocouple. The flask was charged with, 2,5-dimercapto-1,3,4 thiadiazole (30 gm 0.20 mole) and disulphide oil (71.2 gm 0.40 moles). The reaction mixture was heated to 120–140° C. with stirring for 8–10 hrs. and then cooled to room temperature. The reaction mixture was extracted with hexane (275 ml×2 ) and the hexane removed under reduced pressure to get pale yellow product (35.02 gm 34.6%). This product was chemically equivalent to the product of example-1.

Performance Evaluation of synthesized Corrosion Inhibitor vis-à-vis Commercial corrosion Inhibitors

| S. No. | Base Blend | Corrosion inhibitor | Copper Corrosion Rating |
|---|---|---|---|
| 1. | Base oil + 0.2% Elemental sulphur | — | 4 |
| 2. | Base Oil + 0.2% Elemental sulphur | 0.3% of Example 1 | 2 |
| 3. | Base Oil + 0.2% Elemental sulphur | 0.3% of Cuvan 826 | 2 |
| 4. | Base Oil + 4% Sulphurised Isobutylene | — | 3 |
| 5. | Base Oil + 4% Sulphurised Isobutylene | 0.2% of Example 1 | 1 |
| 6. | Base Oil + 4% Sulphurised Isobutylene | 0.2% of Cuvan 826 | 2 |
| 7. | Auto Gear Oil formulation (without corrosion inhibitor) | — | 4 |
| 8. | Auto Gear Oil formulation (without corrosion inhibitor) | 0.25% of Example 1 | 2 |
| 9. | Auto Gear Oil formulation (without corrosion inhibitor) | 0.25% Amoco 150 | 2 |
| 10. | Auto Gear Oil formulation (without corrosion inhibitor) | 0.25% Cuvan 484 | 2 |

What is claimed is:

1. A process for preparing a corrosion inhibitor/metal passivator additive for lubricant, grease and fuel applications from waste refinery streams, comprising reacting 2,5-dimercapto-1,3,4-thiadiazole either in powder form or in solution form in polar organic solvent, with disulphide oil obtained from Merox extraction/caustic wash of the refinery streams.

2. A process as claimed in claim 1 wherein said reaction takes places in the presence of redox agent for better yield.

3. A process as claimed in claim 1 wherein the said corrosion inhibitor/metal passivator additive is 2,5-bis (alkylmercapto)-1,3,4-thiadiazole.

4. The process as claimed in claim 1, wherein the disulphide oil used is obtained from Merox extraction/caustic wash of the cracked LPG.

5. The process as claimed in claim 1, wherein the disulphide oil used is obtained after Merox extraction/caustic wash of the vis-breaker naphtha of boiling range 30–150° C.

6. The process as claimed in claim 1, wherein the disulphide oil used is obtained from Merox extraction/caustic wash of the mixture of sulfur containing refinery streams.

7. The process as claimed in claim 1 wherein the composition of said disulphide oil consists of any number of components ranging from $C_4H_{10}S_2$ to $C_{12}H_{26}S_2$.

8. The process as claimed in claim 7 wherein the composition of said disulphide oil is

| S. No. | Component | Mol. Formula |
|---|---|---|
| 1. | Ethylisopropyl disulphide | $C_5H_{12}S_2$ |
| 2. | Diisopropyl disulphide | $C_6H_{14}S_2$ |
| 3. | Isopropyl n-propyl disulphide | $C_6H_{14}S_2$ |
| 4. | Ethylisobutyl disulphide | $C_6H_{14}S_2$ |
| 5. | Di-n-propyl disulphide | $C_6H_{14}S_2$ |
| 6. | n-Butyl n-propyl disulphide | $C_7H_{16}S_2$ |
| 7. | 2-Methylpropyl n-propyl disulphide | $C_7H_{16}S_2$ |
| 8. | 2-Methylpropyl iso-propyl disulphide | $C_7H_{16}S_2$ |
| 9. | n-butyl isopropyl disulphide | $C_7H_{16}S_2$ |
| 10. | (Amended) The process as claimed in claim 1, wherein the ratio of the reactants 2,5,dimercapto-1,3,4-thiadiazole and disulphide oil is in the ratio 1–4:4–1 | |
| 11. | (Amended) The process as claimed in claim 1, wherein the polar solvent is alkyl alcohol. | |
| 12. | 1-cyclohexyl n-propyl disulphide | $C_9H_{20}S_2$ |
| 13. | (Amended) The process as claimed in claim 12, wherein the polar solvent is alkyl alcohol. | |
| 14. | (Amended) The process as claimed in claim 12, wherein the non-polar solvent used is hexane, petroleum ether, benzene or toluene. | |
| 15. | (Amended) The process as claimed in claim 12, wherein the ratio of the reactants 2,5,dimercapto-1,3,4-thiadiazole and disulphide oil is in the ratio 1–4:4–1. | |
| 16. | $C_5/C_6$ disulphide | $C_{11}H_{24}S_2$. |

9. The process as claimed in claim 2, wherein redox agent used is hydrogen peroxide.

10. The process as claimed in claim 1, wherein the ratio of the reactants 2,5,dimercapto-1,3,4-thiadiazole and disulphide oil is in the ratio 1–4:4–1.

11. The process as claimed in claim 1, wherein the polar solvent is alkyl alcohol.

12. The process as claimed in claim 9, comprising dissolving 2,5,dimercapto-1,3,4-thiadiazole in polar organic solvent, adding drop-wise hydrogen peroxide and the temperature of the mixture is maintained at 15–20° C. till a pale yellow precipitate is separated, the resulting slurry is stirred and disulphide oil is added at room temperature and the reaction mixture is heated to 70–80° C. till reaction is complete, cooling the contents to room temperature and removing the organic solvent under reduced pressure, adding non-polar organic solvent in the residue, separating the said non-polar solvent soluble portion, and distilling off the said non-polar solvent under reduced pressure to obtain light yellow coloured liquid of 2,5-bis bis(alkyldithio)-1,3,4-thiadiazole.

13. The process as claimed in claim 12, wherein the polar solvent is alkyl alcohol.

14. The process as claimed in claim 12, wherein the non-polar solvent used is hexane, petroleum ether, benzene or toluene.

15. The process as claimed in claim 12, wherein the ratio of the reactants 2,5,dimercapto-1,3,4-thiadiazole and disulphide oil is in the ratio 1–4:4–1.

16. The process as claimed in claim 12, wherein 0.5–1.2 mole of 30% hydrogen peroxide is added drop-wise.

17. The process as claimed in claim 12, wherein for completing the reaction, the reaction mixture is refluxed for 6 to 10 hours.

18. The process as claimed in claim 12, wherein 800–1100 ml. of non-polar organic solvent is added for separating the non-polar organic solvent soluble portion.

19. The process as claimed in claim 12, wherein 1–3 moles of disulphide oil is added to the reaction mixture and stirred at room temperature for about 2 hours.

20. A process as claimed in claim 1 comprising reacting 2,5-dimercapto-1,3,4-thiadiazole in powder form with disulphide oil obtained from Merox extraction/caustic wash of the refinery streams, heating the reaction mixture to 120–140° C., cooling the said reaction mixture to room temperature, extracting the reaction mixture with non-polar organic solvent and removing the said non-polar organic solvent under reduced pressure to get pale yellow product of 2,5-bis bis(alkyldithio)-1,3,4-thiadiazole.

21. The process as claimed in claim 20, wherein the non-polar solvent used is hexane, petroleum ether, benzene or toluene.

22. The process as claimed in claim 20, wherein the ratio of the reactants 2,5,dimercapto-1,3,4-thiadiazole and disulphide oil is in the ratio 1–4:4–1.

23. The process as claimed in claim 20, wherein 800–1100 ml. of non-polar organic solvent is added for separating the non-polar organic solvent soluble portion.

24. The lubricating oil composition consisting 0.01 to 6% of 2,5-bis(alkyldithio)-1,3,4-thiadiazole, prepared according to claim 1, as the corrosion inhibitor/metal passivator additive.

25. The lubricating oil composition consisting 0.01 to 6% of 2,5-bis(alkyldithio)-1,3,4-thiadiazole, prepared according to claim 12, as the corrosion inhibitor/metal passivator additive.

26. The lubricating oil composition consisting 0.01 to 6% of 2,5-bis(alkyldithio)-1,3,4-thiadiazole, prepared according to claim 20, as the corrosion inhibitor/metal passivator additive.

27. The process as claimed in claim 1, wherein the ratio of the reactants 2,5,dimercapto-1,3,4-thiadiazole and disulphide oil is in the ratio 1:1.

28. The process as claimed in claim 1, wherein the polar solvent is ethyl alcohol.

29. The process as claimed in claim 12, wherein the polar solvent is ethyl alcohol.

30. The process as claimed in claim 12, wherein the non-polar solvent used is hexane.

31. The process as claimed in claim 12, wherein the ratio of the reactants 2,5,dimercapto-1,3,4-thiadiazole and disulphide oil is in the ratio 1:1.

32. The process as claimed in claim 20, wherein the non-polar solvent used is hexane.

33. The process as claimed in claim 20, wherein the ratio of the reactants 2,5,dimercapto-1,3,4-thiadiazole and disulphide oil is in the ratio 1:1.

* * * * *